US008559834B2

(12) United States Patent
Sawicki et al.

(10) Patent No.: US 8,559,834 B2
(45) Date of Patent: Oct. 15, 2013

(54) VARIABLE HFSI COUNTER FOR THE CHARGING SUBSYSTEM BASED ON GOM (GRAINS OF MOISTURE)

(75) Inventors: Paul F. Sawicki, Rochester, NY (US); Robert S. Pozniakas, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 208 days.

(21) Appl. No.: 13/271,440

(22) Filed: Oct. 12, 2011

(65) Prior Publication Data

US 2013/0094868 A1 Apr. 18, 2013

(51) Int. Cl.
*G03G 15/02* (2006.01)

(52) U.S. Cl.
USPC ..... 399/31; 399/97

(58) Field of Classification Search
USPC ..... 399/9, 31, 38, 50, 91, 97–100
See application file for complete search history.

(56) References Cited

U.S. PATENT DOCUMENTS 4,168,974 A * 9/1979 Ando et al. ..... 430/53
5,182,599 A * 1/1993 Kinoshita ..... 399/74

* cited by examiner

*Primary Examiner* — Hoan Tran
(74) *Attorney, Agent, or Firm* — Fay Sharpe LLP

(57) ABSTRACT

As set forth herein, computer-implemented methods and systems facilitate adjusting an HFSI counter increment as a function of local relative humidity in order to adjust corona device lifespan. Adjustment factors are set for a plurality of GOM levels and an adjustment factor to be applied to the HFSI counter increment is assigned to or set for each GOM level. A curve is determined or calculated that approximates the adjustment factor, and a quadratic equation defining the curve is determined. Humidity measurement data is received from an environmental sensor coupled to the printer device, and depending on the relative humidity in the local environment of the printer, and an adjustment factor derived from the quadratic equation is applied to the HFSI counter increment to adjust for dry or humid conditions.

20 Claims, 4 Drawing Sheets

VARIABLE HFSI COUNTER FOR THE CHARGING SUBSYSTEM BASED ON GOM (GRAINS OF MOISTURE)

TECHNICAL FIELD

The presently disclosed embodiments are directed toward methods and systems for printing, reproducing or displaying images. More particularly, the teachings disclosed herein are applicable to methods and apparatuses that adjust a high-frequency service indicator (HFSI) counter in an environmental sensor as a function of ambient humidity to increase corona device lifespan.

BACKGROUND

In conventional marking modules, printing machine, and the like, ambient humidity can affect device longevity and print quality. Excessive humidity may cause pin growths and/or grid corrosion, and thus limit the useful life of a corona device employed in the printer. Conversely, in low-humidity conditions, a corona device may last beyond a scheduled replacement interval, but such extended life is not quantifiable using conventional approaches.

For example, a corona device may have a manufacturer-suggested replacement interval of one million corona charges, because the particular corona device is factory-proven to be able to produce high-quality images for one million charges in the factory (e.g., at 70% humidity or some other known humidity level in the factory). However, if the printer employing the corona device is then shipped to an arid region and used in an environment of, for example, 20% humidity, the a corona device replacement signal triggered at the one million charge mark may be premature.

There is a need in the art for systems and methods that facilitate extending corona device lifespan and improving print quality while overcoming the aforementioned deficiencies.

BRIEF DESCRIPTION

In one aspect, a computer-implemented method adjusting a high-frequency service indicator (HFSI) counter increment as a function of local relative humidity in order to adjust corona device lifespan comprises setting an adjustment factor for each of a plurality of predefined humidity levels, identifying a curve that defines the adjustment factors as a function of humidity level, and identifying a quadratic equation that defines the curve. The method further comprises receiving humidity measurement information describing a local humidity level in the vicinity of a corona device, and applying an adjustment factor that corresponds to a measured humidity level to an HFSI counter increment to adjust the HFSI counter increment.

In another aspect, a system that facilitates adjusting a high-frequency service indicator (HFSI) counter increment as a function of local relative humidity in order to adjust corona device lifespan comprises a marking module comprising a high-frequency service indicator (HFSI) counter and a corona device. The system further comprises a humidity sensor and a processor configured to set an adjustment factor for each of a plurality of predefined humidity levels, identify a curve that defines the adjustment factors as a function of humidity level, and to identify a quadratic equation that defines the curve. The processor is further configured to receive humidity measurement information describing a local humidity level in the vicinity of a corona device and, upon receipt of the humidity measurement information, apply an adjustment factor that corresponds to a measured humidity level to an HFSI counter increment to adjust the HFSI counter increment.

In yet another aspect, a computer-implemented method for adjusting a high-frequency service indicator (HFSI) counter increment as a function of local relative humidity in order to adjust corona device lifespan comprises storing in non-volatile memory an adjustment factor for each of a plurality of predefined humidity levels, detecting a local relative humidity level in the vicinity of a corona device of printer, and periodically applying an adjustment factor that corresponds to a detected humidity level to an HFSI counter increment to adjust the HFSI counter increment.

DETAILED DESCRIPTION

The above-described problem is solved by continuously modifying a count value on a charge counter (i.e., an HFSI counter) for a corona device in a printer or marking module as a function measured local humidity, so that the corona device is not discarded prematurely. For instance, conventional approaches to corona device replacement in a printer involve replacing the corona device with the HFSI records a predetermined count value (e.g., one million). However, when relative humidity in the local environment in which the printer is employed is low (10% to 20% Rh), the corona device can perform within specification well beyond the usual one million replacement interval. Using conventional approaches, many corona devices are potentially being replaced because the HFSI counter hit the one million mark, upon which an operator is signaled to replace the corona device. The described systems and methods facilitate delaying the triggering of a replacement indication by multiplying the HFSI count by an adjustment factor. It will be appreciated that the described systems and methods are not limited to extending corona device life, but rather can be applied to any device that is affected by humidity.

Figure 1:
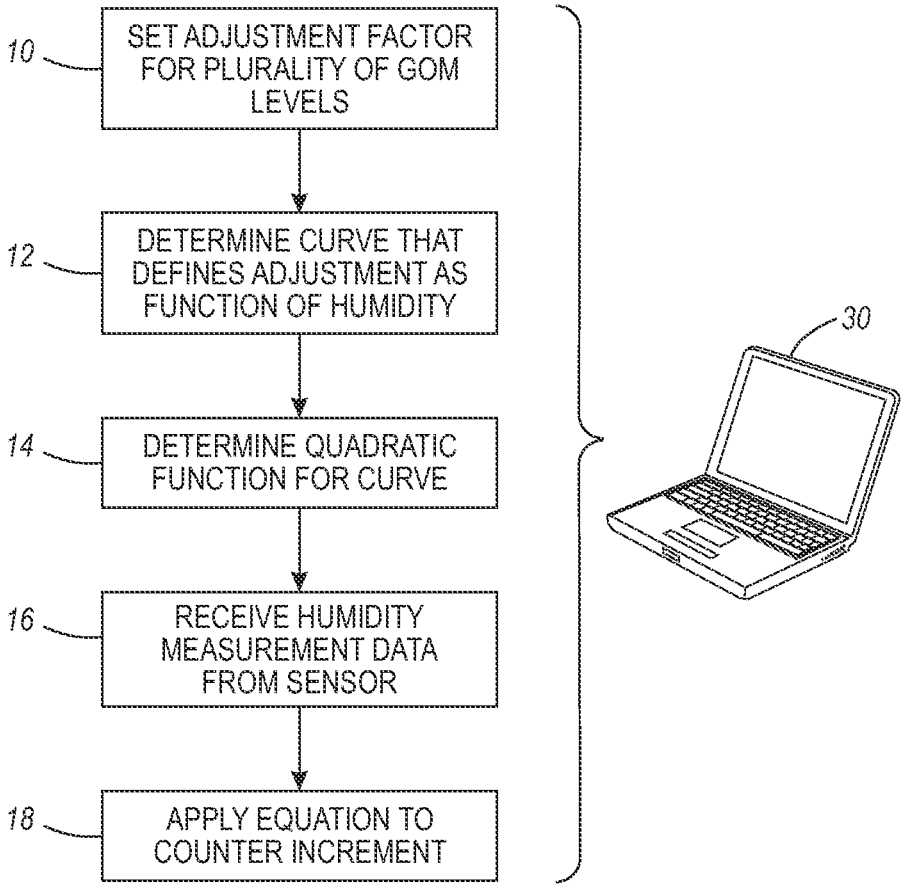
FIG. 1 illustrates a method for adjusting the HFSI counter increment value as a function of local relative humidity in order to adjust corona device lifespan.

FIG. 1 illustrates a method for adjusting the HFSI counter increment value as a function of local relative humidity in order to adjust corona device lifespan. At 10, adjustment factors are set for a plurality of GOM levels (e.g., 10 GOM, 11.5 GOM, 13 GOM, 60 GOM etc.). In one example, the GOM levels are incremental (e.g., 9 GOM, 10 GOM, . . . , 200 GOM, etc.; 10 GOM, 15 GOM, 20 GOM, . . . 300 GOM, etc.; etc.), and ad adjustment factor that is applied to the HFSI counter increment is assigned to or set for each GOM level. At 12, a curve is determined or calculated that approximates the adjustment factor. At 14, a quadratic equation defining the curve is determined. It will be appreciated that the equation described herein and the curve defined thereby is not limited to being quadratic or binomial, but may define a "hockey stick" shape, a third-order curve, or the like. At 16, humidity measurement data is received from an environmental sensor coupled to the printer device. The humidity measurement data make be collected continuously or periodically (e.g., every minute, every 5 minutes, etc.) At 18, the quadratic equation is applied to the HFSI to adjust counter values.

It will be appreciated that the method of FIG. 1 can be implemented by a computer 30, which comprises a processor (such as the processor 104 of FIG. 3) that executes, and a memory (such as the memory 106 of FIG. 3) that stores, computer-executable instructions for providing the various functions, etc., described herein.

The computer 30 can be employed as one possible hardware configuration to support the systems and methods described herein. It is to be appreciated that although a standalone architecture is illustrated, that any suitable computing environment can be employed in accordance with the present embodiments. For example, computing architectures including, but not limited to, stand alone, multiprocessor, distributed, client/server, minicomputer, mainframe, supercomputer, digital and analog can be employed in accordance with the present embodiment.

The computer 30 can include a processing unit (see, e.g., FIG. 8), a system memory (see, e.g., FIG. 3), and a system bus (not shown) that couples various system components including the system memory to the processing unit. The processing unit can be any of various commercially available processors. Dual microprocessors and other multi-processor architectures also can be used as the processing unit.

The computer 30 typically includes at least some form of computer readable media. Computer readable media can be any available media that can be accessed by the computer. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above can also be included within the scope of computer readable media.

A user may enter commands and information into the computer through an input device (not shown) such as a keyboard, a pointing device, such as a mouse, stylus, voice input, or graphical tablet. The computer 30 can operate in a networked environment using logical and/or physical connections to one or more remote computers, such as a remote computer(s). The logical connections depicted include a local area network (LAN) and a wide area network (WAN). Such networking environments are commonplace in offices, enterprise-wide computer networks, intranets and the Internet.

With continued reference to FIG. 1, the quadratic equation determined at 14 and applied to the HFSI counter increment at 16 continuously or periodically modifies the HFSI counter increment, based on values from a built-in (or remote but operably coupled) environmental sensor that monitors local relative humidity in the vicinity of the printer. That is, a grains of moisture (GOM) value and/or a relative humidity percentage is detected by the sensor is used to identify an adjustment factor that is employed to modify the counter increment. In one embodiment, the algorithm modifies the counter increment for each short time increment (e.g., 1 photoreceptor belt cycle). The sum of these modified HFSI increments is the HFSI counter value that the operator sees on the screen. In the case of a corona device grid, the amount of degradation is a function of the GOM under which the degradation occurred. Since the grids can last several months, the GOM can vary significantly over the life of the grid. In one embodiment, the environmental sensor is coupled to a processor in the printer and t periodically or continuously transmits humidity data to the processor. In another embodiment, the sensor periodically or continuously transmits the humidity data wirelessly using one or more known protocols. The drier the environment, (i.e., the lower GOM or % RH measurement), the slower the adjusted HFSI counter value is incremented, thus extending the replacement interval of the corona device. For example, during winter months, at very low GOM levels, the corona device may last up to 50% longer (e.g., having a lifespan of 1.5 million panels vs. 1.0 million panels). GOM values of 10-20 are common during the winter (heating) months and can also occur during the summer (air conditioned) months.

According to another example, the following exemplary environmental zones are employed for illustrative purposes:

Zone 1 (72 F, 10% Rh)=11.5 GOM
Zone 2 (60 F, 20% Rh)=15.2 GOM
Zone 3 (72 F, 55% Rh)=64.2 GOM
Zone 4 (80 F, 80% Rh)=123 GOM In this example, GOM values range from approximately 10 to approximately 123. Low GOM is favorable for extending the life of the Charge device. GOM values of 64 and above may cause pin growths and/or grid corrosion, and thus limit the useful life of the corona device to the typical 1 million panels. Accordingly, in this example, the quadratic curve is fitted at 12 to provide a 50% increase in life at low GOM, with a 0% modification GOM levels from 64 to 123 GOM. The resulting quadratic equation is used to modify and vary the charge HFSI counter increment, at 20.

To prevent confusion to machine operators and field systems engineers, the algorithm can operate in the background (i.e., without the operator's knowledge). If for instance, the printing machine is in a low GOM environment, the algorithm modifies the HFSI counter increment to count the charge panels more slowly. An HFSI GUI screen still counts up to one million panels and signals the operator to replace the corona device once the one million count mark is reached, but in actuality the device may have printed up to 1.5 million panels. Because the algorithm is operating in the background, the operator or field systems engineer does not have to do any math conversions or environment checking. Rather the operator or engineer replaces the corona device at the 1M panel indicator as usual.

According to one aspect, the described approach can be tuned via non-volatile memory (NVM) values to "dial in" potential future corona device life extensions if desired. For instance, the quadratic equation can be tuned to automatically slow the HFSI counter increments so that the 1M count that triggers a replacement indicator is not achieved until a desired number of panels has been printed (e.g., 1.2M, 1.5M, etc.).

According to another aspect, the adjustment factor is updated after each photoreceptor cycle (e.g., every 6 prints or the like), although the adjustment factor updates can be performed more or less frequently (e.g., after each print, once a day, every 5 minutes, etc.).

Figure 2:
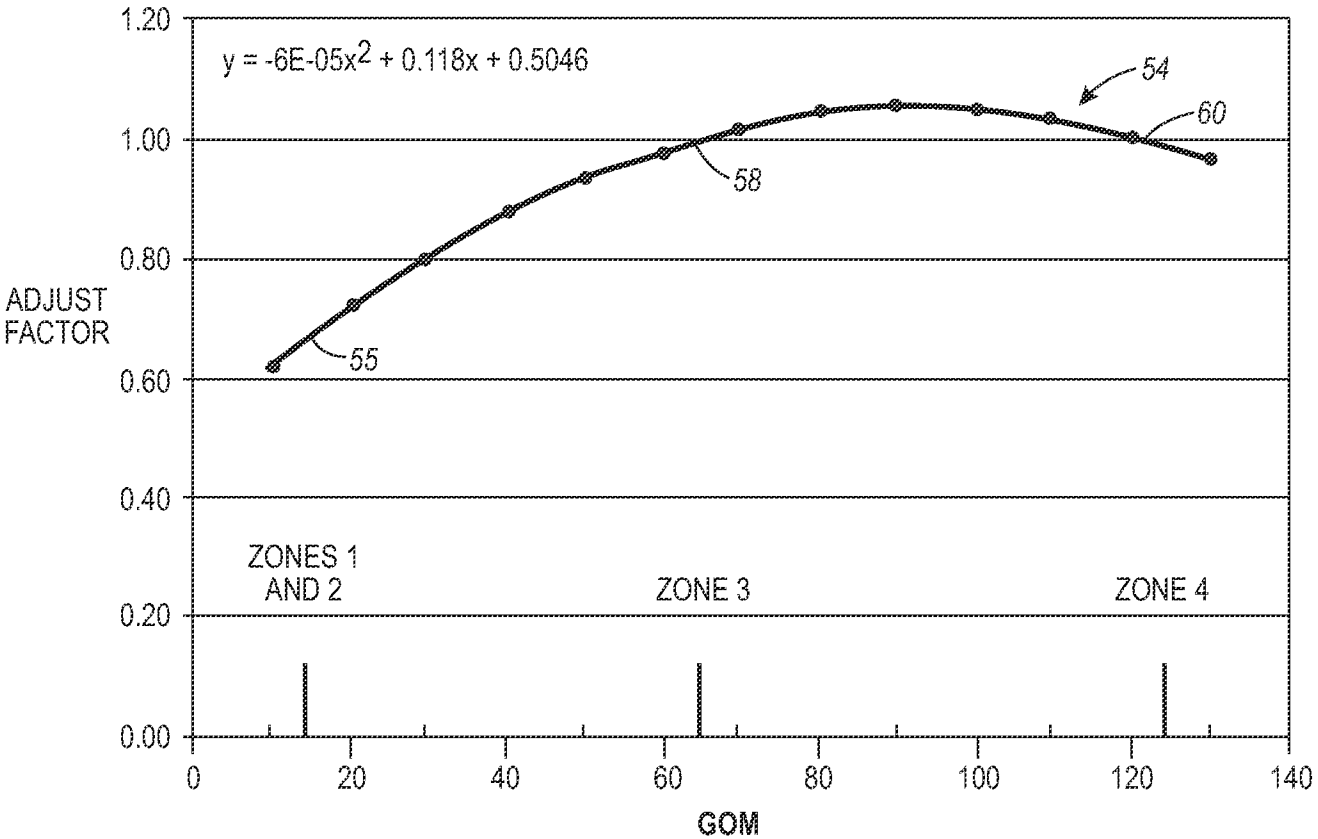
FIG. 2 illustrates a graph for a quadratic equation and its corresponding polynomial curve with GOM on the abscissa with environmental zones labeled, and with adjustment factor on the ordinate.

With continued reference to FIG. 1, FIG. 2 illustrates a graph 50 for a quadratic equation 52 and its corresponding polynomial curve 54 with GOM on the abscissa with environmental zones labeled, and with adjustment factor on the ordinate. The abscissa has labeled GOM levels corresponding to environmental zones 1 and 2 (e.g., approximately 11-15 GOM), zone 3 (at approximately 63 GOM) and Zone 4 (at approximately 123 GOM). The curve 54 shows an adjustment factor 56 of approximately 0.667 at 15 GOM (zones 1 and 2). Thus, a printer or marking module operating in this environment has its HFSI counter increment adjusted by a factor of 0.667, which results in the 1M counter value (i.e., end of life for the corona device) being reached after about 1.5M prints. The curve 54 also shows adjustment factors 58, 60 of approximately 1 for GOM levels of approximately 63 and 123, respectively (corresponding to environmental zones 3 and 4, respectively). Thus, printers or marking modules operating in these environments have HFSI counter increments that are adjusted by a factor of 1 such that the 1M counter mark is reached at approximately 1M prints.

Table 1 shows an example of a quadratic equation as it may be stored in non-volatile memory for use in adjusting the HFSI counter increment as described herein. As

TABLE 1

| NVM Description | NVM Address | NVM Value |
|---|---|---|
| Zero-Order Coefficient | XXX0 | 0.504600 |
| First-Order Coefficient | XXX1 | 0.011774 |
| Second-Order Coefficient | XXX2 | 0.000063 |
| Adjustment Factor | XXX3 | 1.000000 |

Table 2 shows a working example of the herein-described quadratic equation algorithm and adjustment factors such as may be set for a given GOM level and applied to the HFSI counter increment.

TABLE 2

| NVM Description | NVM Address | Input Value |
|---|---|---|
| GOM | XXX6 | 15.00 |
| PT HFSI Counter Value (Charged Panels) | XXX7 | 1,500,000 |
| GOM Adjustment Factor | XXX8 | 0.667 |
| GOM-adjusted Counter Value | XXX9 | 1,000,566 |

The table includes a non-volatile memory description of the value stored in the non-volatile memory, an NVM address or location of the value, and an input value stored at each given NVM address. For instance, a GOM value received from an environmental sensor coupled to the printer may be 15.00 GOM. From the curve developed at 12 (FIG. 1), it is known that the HFSI counter value can be permitted to run as high as 1.5M panel charges, since the local relative humidity is low, and also that the GOM adjustment factor (e.g., the modifier value derived from the quadratic equation) is approximately 0.667. The GOM-adjusted counter value is approximately 1,000,556. That is the count as perceived by the system in which the HFSI counter is employed is approximately 1,000,000, and therefore the system will signal an operator (e.g., via a graphical user interface or the like) to replace the corona device upon reaching the (adjusted) one-million charge mark.

Figure 3:
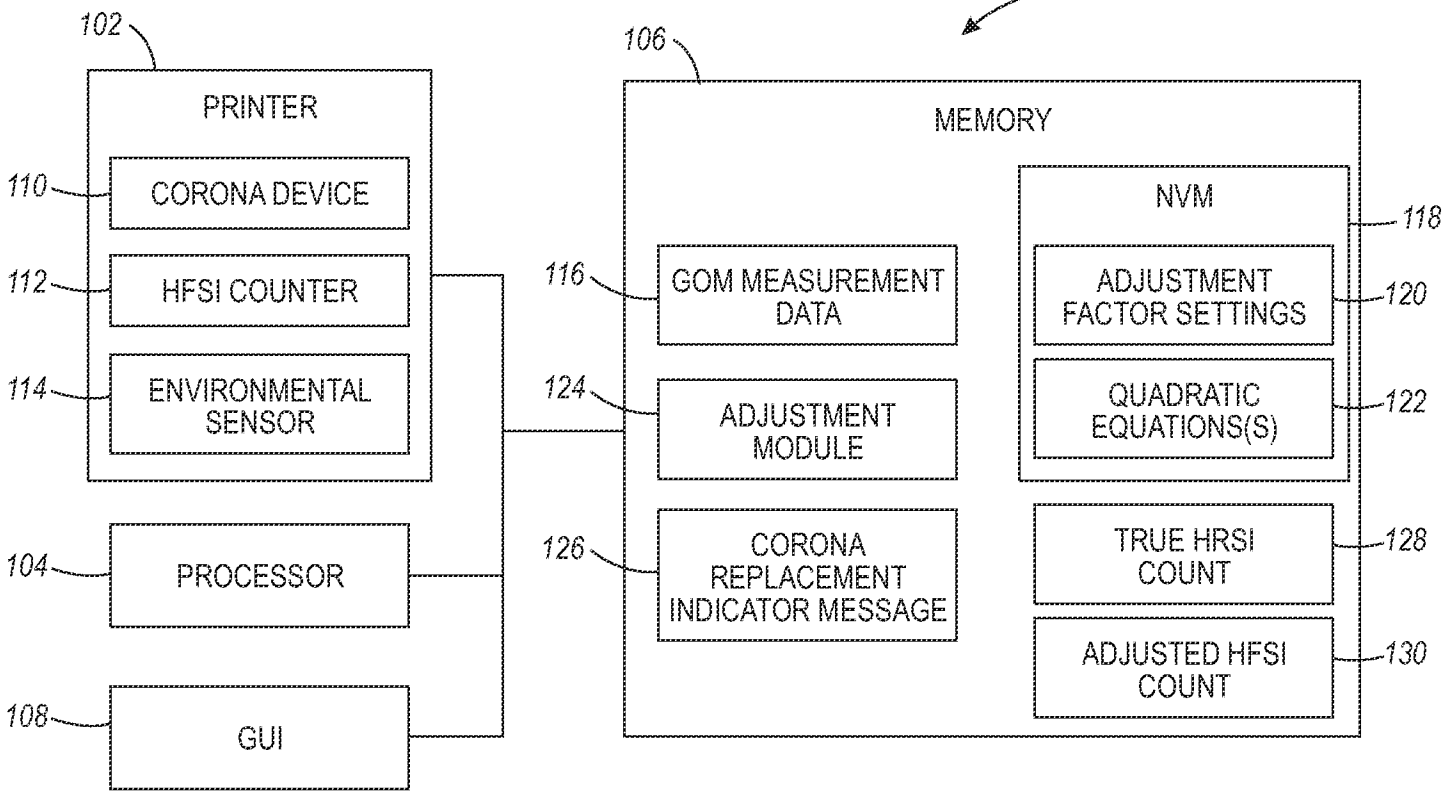
FIG. 3 illustrates a system that facilitates adjusting the HFSI counter increment value as a function of local relative humidity in order to adjust corona device lifespan, in accordance with one or more aspects described herein.

FIG. 3 illustrates a system 100 that facilitates adjusting the HFSI counter increment as a function of local relative humidity in order to adjust corona device lifespan, in accordance with one or more aspects described herein. The system comprises a print engine 102 that is coupled to a processor 104 that executes, and a memory 106 that stores computer-executable instructions for performing the various functions, methods, techniques, steps, and the like described herein. The processor 104 and memory 106 may be integral to each other or remote but operably coupled to each other. In another embodiment, the processor 104 and memory 106 are integral to the printer 102. In another embodiment, the processor and memory reside in a computer (e.g., the computer 30 of FIG. 1) that is operably coupled to the printer 102. The system also comprises a graphical user interface (GUI) 108 on which information is presented to an operator and via which the operator enters information into the system. The GUI may be integral to the printer 102 or remote to the printer an operably coupled thereto.

The printer 102 comprises a corona device 110 that is charged to generate one or more prints, and an HFSI counter 112 that counts each charge on the corona device 102. The printer also comprises and/or is operably coupled to an environmental sensor 114 that senses local relative humidity in the vicinity of the printer 102 by measuring or monitoring GOM levels. GOM measurement data 116 is stored in the memory 106. A non-volatile memory (NVM) component 118 is also comprised by the memory 106 and stores HFSI counter increment adjustment factor settings 120 and quadratic equation information 122 (e.g., as described with regards to FIGS. 1 and 2). In one embodiment, the adjustment factors settings 120 are stored as a lookup table that correlates adjustment factors to humidity levels. An adjustment module 124 (e.g., computer-executable instructions, routine(s), programs, etc.) is stored in the memory 106 and executed by the processor 104 to adjust the HFSI count as a function of measured GOM levels. Once the adjusted HFSI count reaches a predetermined number (e.g., 1,000,000 or some other predetermined number), then a corona device replacement indicator message 126 is presented to an operator via the GUI 108.

According to an example, the environmental sensor may register a local GOM level of 25 GOM. The adjustment factor for a local humidity reading of 25 GOM may be 0.800. In this case, the HFSI counter increments will be multiplied by 0.800, so that an end-of-life value of 1,000,000 charges of the corona device will be reached at approximately 1,250,000 corona charges (assuming the 25 GOM humidity level is detected at the beginning of the corona device's life and remains constant throughout the life of the corona device). In another example, the adjustment factor applied to the HFSI counter increment values is varied over the lifetime of the corona device as a function of the local humidity level at any given time.

Additionally, the memory stores an original (i.e. true) up-to-date HFSI counter value 128 and an adjusted HFSI counter value 130 to which an adjustment factor has been applied. To generate the adjusted HFSI count, the processor 104 applies to the counter increment a first adjustment factor that is identified as corresponding to a first humidity level. If a second humidity reading indicates that the adjusted HFSI increment is to be recalibrated, then the HFSI increment is multiplied by a second adjustment factor that corresponds to the subsequent humidity level.

As stated above, the system 100 comprises the processor 104 that executes, and the memory 106 that stores one or more computer-executable modules (e.g., programs, computer-executable instructions, etc.) for performing the various functions, methods, procedures, etc., described herein. Additionally, "module," as used herein, denotes a set of computer-executable instructions, software code, program, routine, or other computer-executable means for performing the described function, or the like, as will be understood by those of skill in the art. Additionally, or alternatively, one or more of the functions described with regard to the modules herein may be performed manually.

The memory may be a computer-readable medium on which a control program is stored, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, RAM, ROM, PROM, EPROM, FLASH-EPROM, variants thereof, other memory chip or cartridge, or any other tangible medium from which the processor can read and execute. In this context, the systems described herein may be implemented on or as one or more general purpose computers, special purpose computer(s), a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA, Graphical card CPU (GPU), or PAL, or the like.

Figure 4:
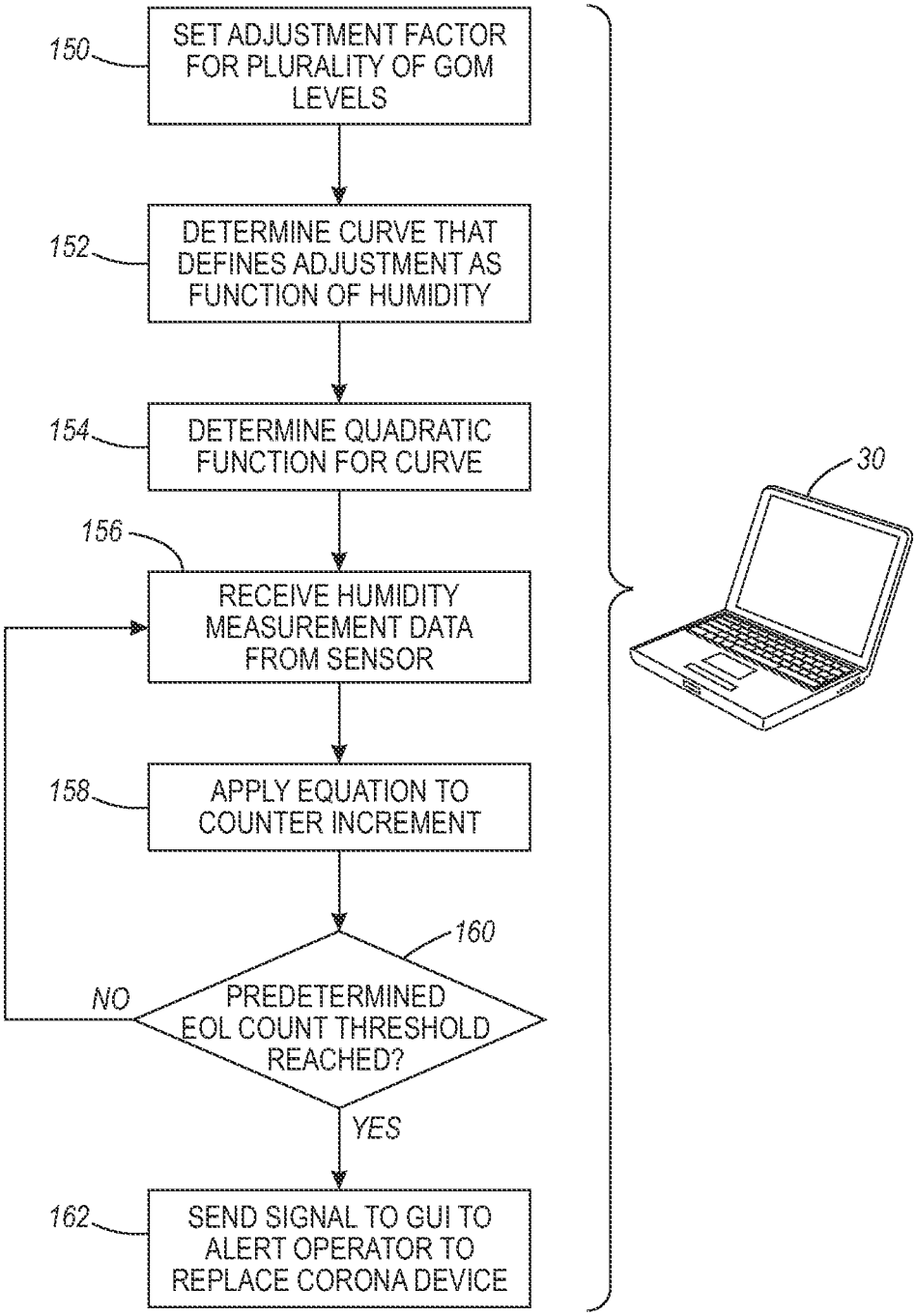
FIG. 4 illustrates a method of adjusting the HFSI counter increment value as a function of local relative humidity in order to adjust corona device lifespan wherein the adjustment factor is varied over time.

FIG. 4 illustrates a method of adjusting the HFSI counter increment as a function of local relative humidity in order to adjust corona device lifespan wherein the adjustment factor is varied over time. At 150, adjustment factors are set for a plurality of GOM (or % RH) levels. At 152, a curve that defines the adjustment factors as a function of humidity levels is determined. At 154, a quadratic function describing the curve is identified or determined. At 156, humidity measurement data is received form an environmental sensor. At 158, the quadratic equation is applied to the HFSI counter increment. At 160, a determination is made regarding whether a predetermined end-of-life (EOL) count has been reached by the HFSI counter. If not, then the method reverts to 156 for continued humidity monitoring and HFSI counter increment adjustment. If the EOL count has been reached, then at 162, a signal is sent to a GUI to alert an operator that the corona device needs replacing.

The exemplary embodiments have been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A computer-implemented method of adjusting a high-frequency service indicator (HFSI) counter increment as a function of local relative humidity in order to adjust corona device lifespan, comprising:

setting an adjustment factor for each of a plurality of predefined humidity levels;

identifying a curve that defines the adjustment factors as a function of humidity level;

identifying a quadratic equation that defines the curve;

receiving humidity measurement information describing a local humidity level in the vicinity of a corona device;

applying an adjustment factor that corresponds to a measured humidity level to an HFSI counter increment to adjust the HFSI counter value.

2. The method according to claim 1, wherein the humidity measurement information includes local relative humidity levels measured in at least one of grains of moisture (GOM) and percentage relative humidity.

3. The method according to claim 1, wherein the humidity measurement information is received periodically from an environmental sensor that is located in the vicinity of the corona device.

4. The method according to claim 1, further comprising:

determining whether a predetermined end-of-life (EOL) count value has been reached by the HFSI counter;

if the EOL count value has not been reached, continuing to measure humidity levels and adjust the HFSI counter increment as a function of the measured humidity levels; and if the EOL count value has been reached, alerting an operator via a graphical user interface (GUI) to replace the corona device.

5. The method according to claim 1, wherein applying the adjustment factor comprises multiplying the HFSI counter increment by the adjustment factor.

6. The method according to claim 1, wherein the adjustment factor is less than 1.0 when the measured humidity level is less than 60 GOM.

7. A processor configured to execute computer-executable instructions for performing the method of claim 1, the instructions being stored on a computer-readable medium.

8. A system that facilitates adjusting a high-frequency service indicator (HFSI) counter increment as a function of local relative humidity in order to adjust corona device lifespan, comprising:

a marking module comprising a high-frequency service indicator (HFSI) counter and a corona device;

a humidity sensor; and a processor configured to:

set an adjustment factor for each of a plurality of predefined humidity levels;

identify a curve that defines the adjustment factors as a function of humidity level;

identify a quadratic equation that defines the curve;

receive humidity measurement information describing a local humidity level in the vicinity of a corona device; and upon receipt of the humidity measurement information, apply an adjustment factor that corresponds to a measured humidity level to an HFSI counter increment to adjust the HFSI counter increment.

9. The system according to claim 8, wherein the humidity measurement information includes local relative humidity levels measured in at least one of grains of moisture (GOM) and percentage relative humidity.

10. The system according to claim 8, wherein the humidity sensor collects the humidity measurement information and periodically transmits it to the processor.

11. The system according to claim 9, where the humidity sensor is located in the vicinity of the marking module and transmits the humidity measurement information wirelessly to the processor.

12. The system according to claim 8, where the processor is further configured to:

determine whether a predetermined end-of-life (EOL) count value has been reached by the HFSI counter;

if the EOL count value has not been reached, continue to measure humidity levels and adjust the HFSI counter increment as a function of the measured humidity levels; and if the EOL count value has been reached, provide an alert to an operator via a graphical user interface (GUI) to replace the corona device.

13. The system according to claim 8, wherein the processor applies the adjustment factor by multiplying the HFSI counter increment by the adjustment factor.

14. The system according to claim 8, wherein the adjustment factor is less than 1.0 when the measured humidity level is less than 60 GOM.

15. The system according to claim 8, further comprising a computer readable medium that comprises a non-volatile memory (NVM) component in which are stored:

an adjustment factor lookup table that correlates adjustment factors to respective humidity levels; and the identified quadratic equation.

16. A computer-implemented method for adjusting a high-frequency service indicator (HFSI) counter increment as a function of local relative humidity in order to adjust corona device lifespan, comprising:

storing in non-volatile memory an adjustment factor for each of a plurality of predefined humidity levels;

detecting a local relative humidity level in the vicinity of a corona device of printer; and periodically applying an adjustment factor that corresponds to a detected humidity level to an HFSI counter increment to adjust the HFSI counter increment.

17. The method according to claim 16, wherein the local relative humidity level is measured in at least one of grains of moisture (GOM) and percentage relative humidity.

18. The method according to claim 16, further comprising:

determining whether a predetermined end-of-life (EOL) count value has been reached by the HFSI counter;

if the EOL count value has not been reached, continuing to measure humidity levels and adjusting the HFSI counter increment as a function of the measured humidity levels; and if the EOL count value has been reached, provide an alert to an operator via a graphical user interface (GUI) to replace the corona device.

19. The method according to claim 16, further comprising applying the adjustment factor by multiplying the HFSI counter increment by the adjustment factor.

20. The method according to claim 16, wherein the adjustment factor is less than 1.0 when the detected humidity level is less than 60 GOM.

* * * * *